US006840652B1

(12) United States Patent
Hymer

(10) Patent No.: US 6,840,652 B1
(45) Date of Patent: Jan. 11, 2005

(54) LIGHTING ENHANCED BY MAGNIFIED REFLECTIVE SURFACES

(75) Inventor: Jeff L. Hymer, Bannister, MI (US)

(73) Assignee: Hi-Lite Safety Systems, L.C., Palm Beach Gardens, FL (US)

( * ) Notice: Subject to any disclaimer, the term of this patent is extended or adjusted under 35 U.S.C. 154(b) by 0 days.

(21) Appl. No.: 10/208,665

(22) Filed: Jul. 30, 2002

Related U.S. Application Data

(60) Provisional application No. 60/309,014, filed on Jul. 31, 2001.

(51) Int. Cl.[7] ..... F21V 21/00

(52) U.S. Cl. ..... 362/235; 362/249; 362/252; 362/800

(58) Field of Search ..... 362/235, 249, 362/252, 247, 800, 545

(56) References Cited

U.S. PATENT DOCUMENTS 5,471,371 A * 11/1995 Koppolu et al. ..... 362/555
5,639,158 A * 6/1997 Sato ..... 362/247
6,238,073 B1 * 5/2001 Ito et al. ..... 362/544
6,474,852 B1 * 11/2002 Ohkohdo et al. ..... 362/487
6,491,412 B1 * 12/2002 Bowman et al. ..... 362/249
6,641,287 B2 * 11/2003 Suehiro ..... 362/298

* cited by examiner

*Primary Examiner*—Thomas M. Sember
(74) *Attorney, Agent, or Firm*—James M. Deimen

(57) ABSTRACT

A light comprises a combination of light reflective and light refractive surfaces with geometric configuration of light emitting diodes (LED's). With the geometric configurations, the number of LED's can be minimized while retaining the redundancy that substantially eliminates the threat of a burned out lamp or light fixture. The LED configuration permits a beam or flood of light of circular or oblong shape depending on the reflectors and covering lens. In general, the LED's are located at the center of, or about the inside periphery of, the lamp and directed toward the shaped reflective surfaces at the back of the lamp. The reflective surfaces direct the light through a covering lens that may or may not refract the light passing through.

5 Claims, 2 Drawing Sheets

FIG 1
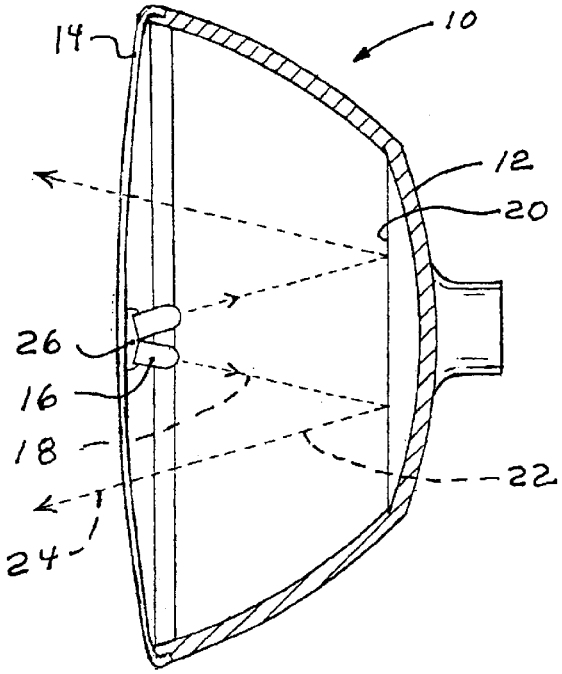
FIG 2
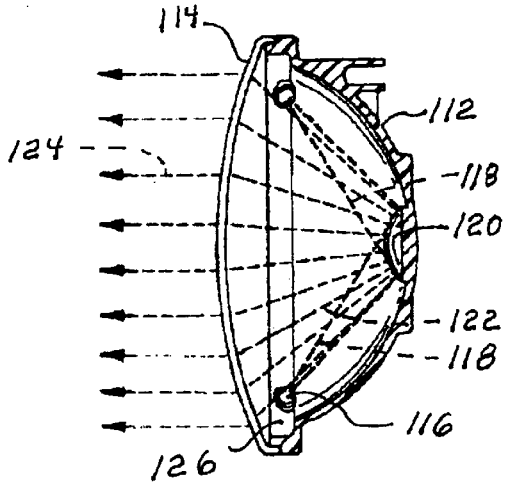
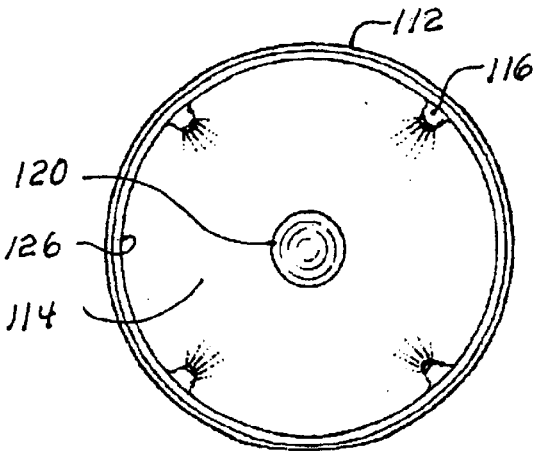
FIG 3

LIGHTING ENHANCED BY MAGNIFIED REFLECTIVE SURFACES

This application claims the benefit of provisional patent application No. 60/309,014, filed Jul. 31, 2001.

BACKGROUND OF THE INVENTION

The field of the invention pertains to lights and reflective and refractive surfaces to enhance the effectiveness of lights. In particular, the invention pertains to devices in combination with light emitting diodes to enhance the usefulness of light emitting diodes and other solid-state light emitting devices.

The light from incandescent and flourescent light sources has been focused, collimated or otherwise directed from almost the time such light sources became available. More recently, the advent of light emitting diodes (LED's) and similar illumination devices at very inexpensive cost has permitted the use of a plurality of LED's to substitute for a single incandescent light source. The multiple LED's provide for greatly extended life in motor vehicle applications as well as other applications and, in many applications, provides a very attractive appearance. In other applications, however, a large plurality of LED's is not necessary, and an approach that minimizes the number of LED's would be advantageous.

SUMMARY OF THE INVENTION

The invention comprises combinations of light reflective and light refractive surfaces with geometric configurations of LED's.

With the geometric configurations, the number of LED's can be minimized while retaining the redundancy that substantially eliminates the threat of a burned out lamp or light fixture. The LED configuration permits a beam or flood light of circular or oblong shape depending on the reflectors and covering lens. In general, the LED's are located at the center of, or about the inside periphery of, the lamp and directed toward shaped reflective surfaces at the back of the lamp. The reflective surfaces direct the light through a covering lens that may or may not refract the light passing therethrough.

BRIEF DESCRIPTION OF THE DRAWINGS

FIG. 1 is a side cross-section of a basic floodlight configuration;

FIG. 2 is a side cross-section of a beam light configuration;

FIG. 3 is a front view of the beam light of FIG. 2;

DESCRIPTION OF THE PREFERRED EMBODIMENTS

Figure 4:
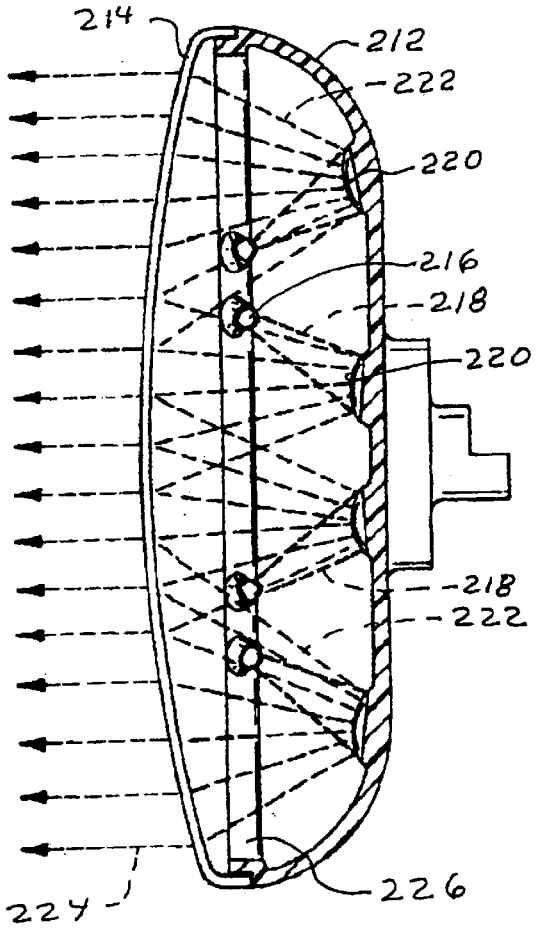
FIG. 4 is a side cross-section of an oblong beam light configuration.

Illustrated in FIG. 1 is a lamp generally denoted by 10 having an opaque back 12 and a transparent or translucent lens 14. Mounted to the inside center 26 of the lens 14 is a plurality of LED's 16 which direct light 18 toward a reflective surface 20. The reflective surface 20 redirects the light 22 through the lens 14. As shown, the reflective surface 20 is flat and lens 14 merely allows the light 22 to pass therethrough without any substantial refraction. The result is an ever broadening cone-shaped dispersal of light 24.

By changing the shape of the reflective surface 20 and the refraction of the lens 14, the dispersal pattern of the light may be controlled. In particular, because most LED's tend to have a relatively narrow dispersal of about 3° to 12°, the reflective surface 20 may be advantageously convex to increase the light dispersal as it is redirected toward the lens 14. Tests have shown that despite the increasing dispersal of the light, the light from the lamp appears to brighten. Although only two LED's 16 are shown, several more may be clustered at the center to increase both brightness and redundancy of the lamp.

In FIGS. 2 and 3, the opaque amp back 112 supports a refractive lens 114 and a convex reflective surface 120. Inside the periphery 126 of the lamp is a plurality of LED's 116 which direct light 118 toward the reflective surface 120 which, in turn, redirects light 122 through the lens 114. The lens 114 refracts the light to form a beam 124 of light with substantially minimal dispersal. With this configuration, a much larger number of LED's may be selected with greater redundancy and brightness than with center mounted LED's.

Figure 5:
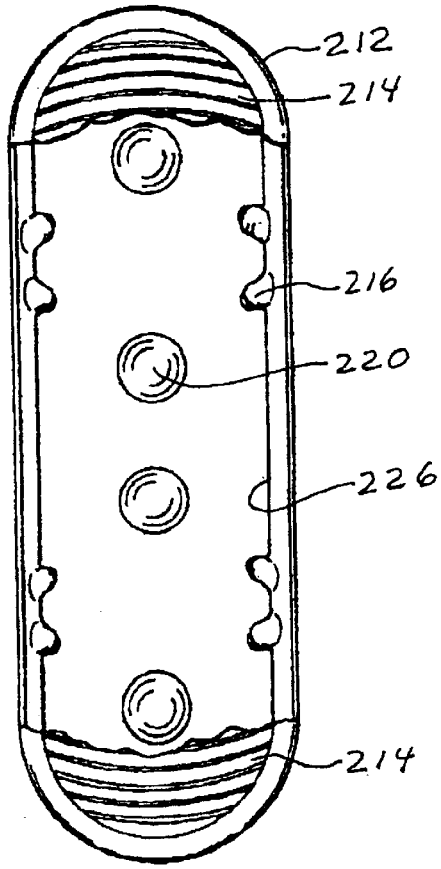
FIG. 5 is a front view of the oblong beam light of FIG. 4.

In FIGS. 4 and 5, the opaque back 212 is oblong as is the covering lens 214. A plurality of convex reflective surfaces 220 are mounted to the inside of the back 212 and employed to redirect light 218 emitted by a plurality of LED's 216 mounted to the inside periphery 226 of the lamp. The redirected light 222 passes through the lens 214 and is refracted to form a beam 224. In this version of the lamp, the beam 224 is oblong. With a substantially non-circular lens shape the use of peripheral LED's is particularly advantageous because the exiting light beam can be made much more uniform in brightness than with one or a limited number of incandescent bulbs.

Although the lamp configurations of FIGS. 2 through 5 are particularly suited to automobile and truck uses, they are not limited thereto. Architectural uses are also very suitable, in particular, in locations where it is particularly difficult to replace a burned-out incandescent lamp.

What is claimed is:

1. A lamp comprising a back and a lens, said back and lens enclosing a volume, a reflective surface within the volume substantially at the back, a plurality of light emitting diodes attached to the lens within the volume, said plurality of light emitting diodes positioned to direct light toward the reflective surface whereby the light is reflected through the lens from within the volume.

2. The lamp of claim 1 wherein the plurality of light emitting diodes are spaced from inside the periphery of the volume.

3. The lamp of claim 1 wherein the reflective surface and lens are substantially round and the plurality of light emitting diodes are located at the center of the lens inside the volume.

4. The lamp or claim 1 wherein at least a portion of the reflective surface is substantially flat.

5. The lamp of claim 1 wherein the plurality of light emitting diodes are oblique to the reflective surface.

* * * * *